US011196214B2

(12) United States Patent
Ikeya et al.

(10) Patent No.: US 11,196,214 B2
(45) Date of Patent: Dec. 7, 2021

(54) CONNECTOR

(71) Applicant: Yazaki Corporation, Tokyo (JP)

(72) Inventors: Kazuhide Ikeya, Makinohara (JP); Hikaru Anma, Makinohara (JP); Sho Kasuya, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 16/842,986

(22) Filed: Apr. 8, 2020

(65) Prior Publication Data

US 2020/0321726 A1 Oct. 8, 2020

(30) Foreign Application Priority Data

Apr. 8, 2019 (JP) ..... JP2019-073650

(51) Int. Cl.
*H01R 13/627* (2006.01)

(52) U.S. Cl.
CPC ..... *H01R 13/6272* (2013.01)

(58) Field of Classification Search
CPC ..... H01R 13/6271–6275
USPC ..... 439/357, 358
See application file for complete search history.

(56) References Cited

U.S. PATENT DOCUMENTS 7,056,142 B2 * 6/2006 Ueda ..... H01R 13/6272 439/328
7,267,570 B2 * 9/2007 Fry, Jr. ..... H01R 13/6272 439/357
7,883,350 B2 * 2/2011 Byrnes ..... H01R 12/79 439/329
8,337,235 B2 * 12/2012 Mizutani ..... H01R 13/6272 439/358
8,882,528 B2 * 11/2014 Sasho ..... H01R 13/6335 439/358
10,424,870 B2 9/2019 Kanda et al.
2001/0001750 A1 * 5/2001 Kawase ..... H01R 13/6272 439/489
2001/0035652 A1 * 11/2001 Wada ..... H01R 13/6272 292/128

(Continued)

FOREIGN PATENT DOCUMENTS

CN 104143726 A 11/2014
JP H01-119180 U 8/1989

(Continued)

*Primary Examiner* — Gary F Paumen
(74) *Attorney, Agent, or Firm* — Banner & Witcoff, Ltd.

(57) ABSTRACT

A connector includes a housing having a housing body, a lock arm and a protective wall. The lock arm includes a swingable arm, a lock claw and a locking projection. The protective wall includes a turn-up preventing projection projecting toward the swingable arm, the turn-up preventing projection being provided such that the locking projection is disposed between the housing body and the turn-up preventing projection and such that the locking projection and the turn-up preventing projection overlap each other in a direction in which the swingable arm swings. With respect to the fitting direction, a front end surface of the locking projection and a front end surface of the turn-up preventing projection are flush with each other and a rear end surface of the locking projection and a rear end surface of the turn-up preventing projection are flush with each other.

3 Claims, 6 Drawing Sheets

(56) References Cited

U.S. PATENT DOCUMENTS

| | | | | |
|---|---|---|---|---|
| 2004/0005805 | A1* | 1/2004 | Shibata | H01R 13/5219 439/358 |
| 2004/0142591 | A1* | 7/2004 | Yamawaki | H01R 13/6272 439/358 |
| 2008/0153341 | A1* | 6/2008 | Shigeta | H01R 13/6272 439/352 |
| 2009/0255596 | A1* | 10/2009 | Leys | F16K 11/20 137/606 |
| 2012/0219357 | A1* | 8/2012 | Mizutani | H01R 13/6272 403/321 |
| 2014/0087580 | A1* | 3/2014 | Sugimoto | H01R 13/6272 439/352 |
| 2014/0179146 | A1* | 6/2014 | Hamai | H01R 13/6272 439/357 |
| 2017/0018874 | A1* | 1/2017 | Kida | H01R 13/6272 |
| 2018/0076566 | A1 | 3/2018 | Kanda et al. | |

FOREIGN PATENT DOCUMENTS

| | | | |
|---|---|---|---|
| JP | 2006344475 | A | 12/2006 |
| JP | 2010262281 | A | 11/2010 |
| JP | 2010262810 | A | 11/2010 |
| JP | 2017-191746 | A | 10/2017 |
| JP | 2018-045781 | A | 3/2018 |

* cited by examiner

CONNECTOR

CROSS-REFERENCE TO RELATED APPLICATION

The present application claims priority to Japanese Patent Application No. 2019-073650 filed on Apr. 8, 2019, the entire content of which is incorporated herein by reference.

TECHNICAL FIELD

The present invention relates to a connector.

BACKGROUND

A related art connector provided with a housing, the housing being to be fitted into a mating housing, includes a lock arm in which a lock claw for locking a projection of the mating housing is formed. In this connector, a stopper protruding toward a lateral side is formed at a rear end of the lock arm, and the stopper is brought into contact with an interference portion formed in a hood portion surrounding the lock arm, thereby preventing the lock arm from being excessively deformed and broken (see, for example, JP2017-45781A and JP2017-191746A).

However, to provide the stopper and the interference portion respectively in the lock arm and the hood portion, the stopper and the interference portion being to be brought into contact with each other, a mold for forming the housing may have a complicated shape and therefore the manufacturing cost thereof may be increased.

SUMMARY

Illustrative aspects of the present invention provide a connector configured to prevent excessive deformation of a lock arm caused by an external force while suppressing an increase of the manufacturing cost at the same time.

According to an illustrative aspect of the present invention, a connector includes a housing having a housing body configured to be fitted to a mating housing, a lock arm provided on an outer periphery of the housing body, the lock arm being configured to engage with a projection portion of the mating housing to lock the projection portion and a protective wall provided upright on the housing body and extending along both sides of the lock arm. The lock arm includes a swingable arm extending along a fitting direction in which the housing is fitted to the mating housing, the swingable arm being supported such that the swingable arm is swingable relative to the housing body a lock claw provided on a front side of the swingable arm in the fitting direction, the lock claw projecting toward the housing body, the lock claw being configured to lock the projection portion when the housing body is fitted to the mating housing and a locking projection provided at a rear side of the swingable arm in the fitting direction, the locking projection laterally projecting from both sides of the swingable arm. The protective wall includes a turn-up preventing projection projecting toward the swingable arm, the turn-up preventing projection being provided such that the locking projection is disposed between the housing body and the turn-up preventing projection and such that the locking projection and the turn-up preventing projection overlap each other in a direction in which the swingable arm swings. With respect to the fitting direction, a front end surface of the locking projection and a front end surface of the turn-up preventing projection are flush with each other and a rear end surface of the locking projection and a rear end surface of the turn-up preventing projection are flush with each other.

Other aspects and advantages of the invention will be apparent from the following description, the drawings and the claims.

BRIEF DESCRIPTION OF THE DRAWINGS

FIGS. 4A and 4B are views showing a lock mechanism of the female housing, in which FIG. 4A is a top view of the female housing, and FIG. 4B is a longitudinal cross-sectional view of an upper portion of the female housing;

FIGS. 5A and 5B are views showing the lock mechanism of the female housing, in which FIG. 5A is a perspective view of the upper portion of the female housing as view from the rear thereof, and FIG. 5B is a rear view of the upper portion of the female housing; and FIGS. 6A and 6B are views showing a turn-up preventing projection and a locking projection, in which FIG. 6A is a perspective view of a cross section taken along a line A-A in FIG. 5B, and FIG. 6B is a cross-sectional view taken along the line A-A in FIG. 5B.

DETAILED DESCRIPTION

Figure 1:
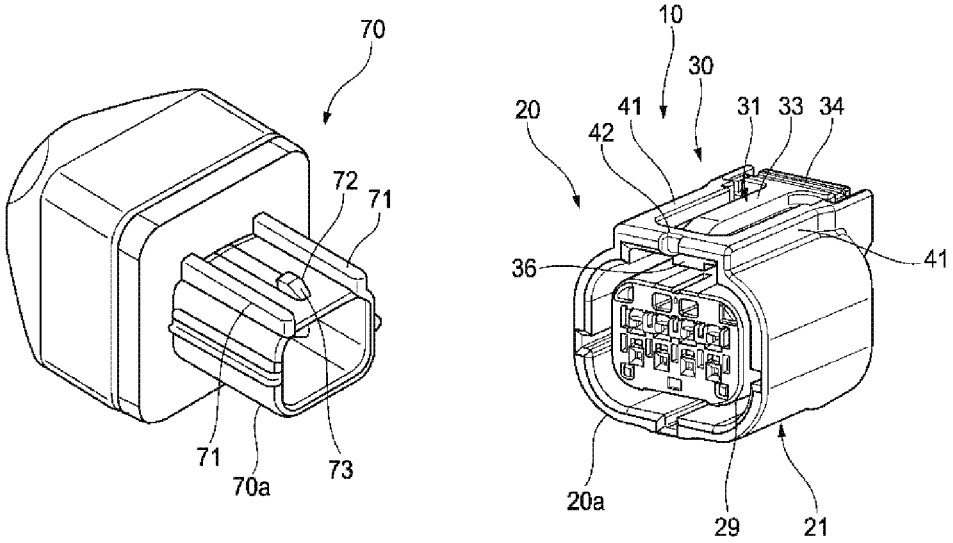
FIG. 1 is a perspective view of a male housing and a female housing of a connector according to an embodiment.

Hereinafter, an embodiment of the invention will be described with reference to the drawings. FIG. 1 is a perspective view of a male housing and a female housing of a connector according to the present embodiment. As illustrated in FIG. 1, a connector 10 according to the present embodiment includes a female housing (housing) 20 that is to be fitted into a male housing (mating housing) 70.

The male housing 70 includes a connection portion 70*a*. The female housing 20 includes a hood portion 20*a*. The male housing 70 and the female housing 20 are to be joined to each other by inserting the connection portion 70*a* of the male housing 70 into the hood portion 20*a* of the female housing 20.

The male housing 70 is formed of a synthetic resin and includes the tubular connection portion 70*a*. A plurality of male terminals (not shown) is provided in the male housing 70, and these male terminals are arranged in the connection portion 70*a*.

The male housing 70 includes a pair of guide projections 71 and a projection portion 72 on an upper surface of the connection portion 70*a*. The guide projections 71 are formed along a lengthwise direction of the connector 10, i.e., a direction in which the female housing 20 is fitted to the male housing 70 or a direction in which the female housing 20 gets close to the male housing 70 to be fitted to the male housing 70 (hereinafter, simply referred to as a fitting direction). The guide projections 71 are spaced apart from each other in a widthwise direction perpendicular to the fitting direction. The projection portion 72 is formed in the middle of the widthwise direction of the upper surface of the connection portion 70*a*, between the pair of guide projections 71. The projection portion 72 projects from the upper surface of the connection portion 70*a*. A guide surface 73 that is gradually inclined upward toward the rear of the male housing 70, i.e., toward an end side of the male housing 70 in the lengthwise direction which does not face the female housing 20 when the male housing 70 being fitted to the female housing 20, is formed in the vicinity of a distal end of the connection portion 70*a*, i.e., the other end side in the lengthwise direction which faces the female housing 20 when the male housing 70 being fitted to the female housing 20.

Figure 2:
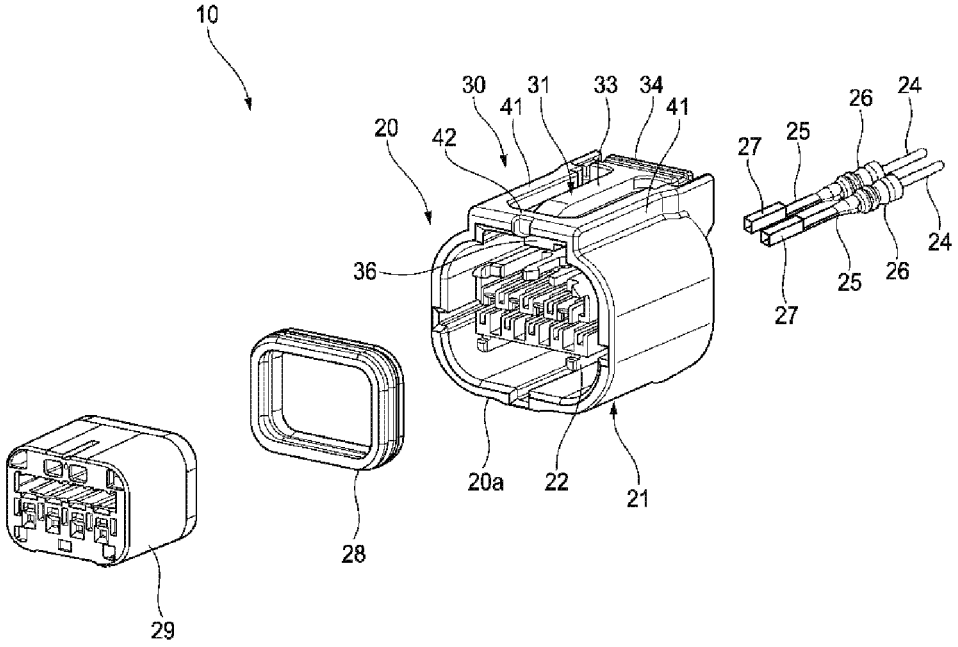
FIG. 2 is an exploded perspective view of the female housing.
Figure 3:
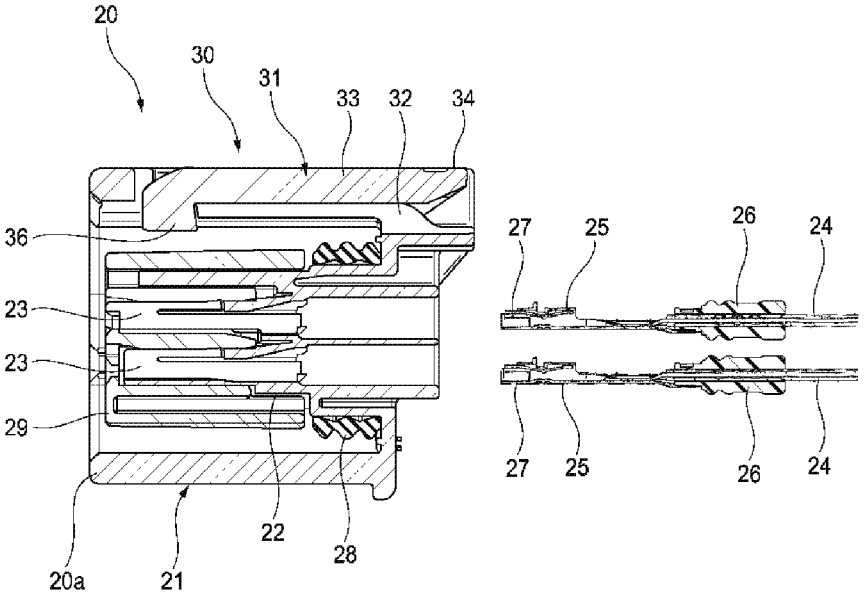
FIG. 3 is a longitudinal cross-sectional view of the female housing.

FIG. 2 is an exploded perspective view of the female housing. FIG. 3 is a longitudinal cross-sectional view of the female housing. As illustrated in FIGS. 2 and 3, the female housing 20 includes a housing body 21 having the hood portion 20*a* formed in a tubular shape, and a fitting portion 22 projecting in the housing body 21. The female housing 20 is formed of a synthetic resin, and a plurality of terminal accommodating chambers 23 are formed in the fitting portion 22. A female terminal 25 connected to an distal end of an electric wire 24 is to be accommodated in each of the terminal accommodating chambers 23, and the electric wire 24 is to be drawn out from a rear end of the housing body 21, i.e, an end in the lengthwise direction which does not face the male housing 70 when the female housing 20 being fitted to the male housing 70. A seal member 26 attached to the electric wire 24 is to be fitted into the terminal accommodating chamber 23 from the rear of the housing body 21. Accordingly, the terminal accommodating chamber 23 of the housing body 21 in which the female terminal 25 is to be accommodated is sealed by the seal member 26 so that water does not get into the terminal accommodating chamber 23.

The female terminal 25 is formed of, for example, a conductive metal material such as copper or a copper alloy, and is connected to the electric wire 24 by crimping. The female terminal 25 includes an electrical connection portion 27 formed in a tubular shape.

An annular seal member 28 is for sealing a portion at which the male housing 70 and the female housing 20 are joined (a joint portion). The annular seal member 28 is to be attached from a tip end side to the fitting portion 22 of the female housing 20, i.e., the other end side in the lengthwise direction which faces the male housing 70 when the female housing 20 being fitted to the make housing 70. Further, a front holder 29 molded from a synthetic resin is attached to the fitting portion 22. By virtue of the front holder 29 being attached to the fitting portion 22, the female terminal 25 accommodated in the terminal accommodating chamber 23 is prevented from moving forward in the fitting direction, i.e., the female terminal 25 is prevented from moving toward a direction in which the female terminal 25 is further inserted into the terminal accommodating chamber 23. Also, the front holder 29 retains the sealing member 28 held on the fitting portion 22.

Figure 4A:
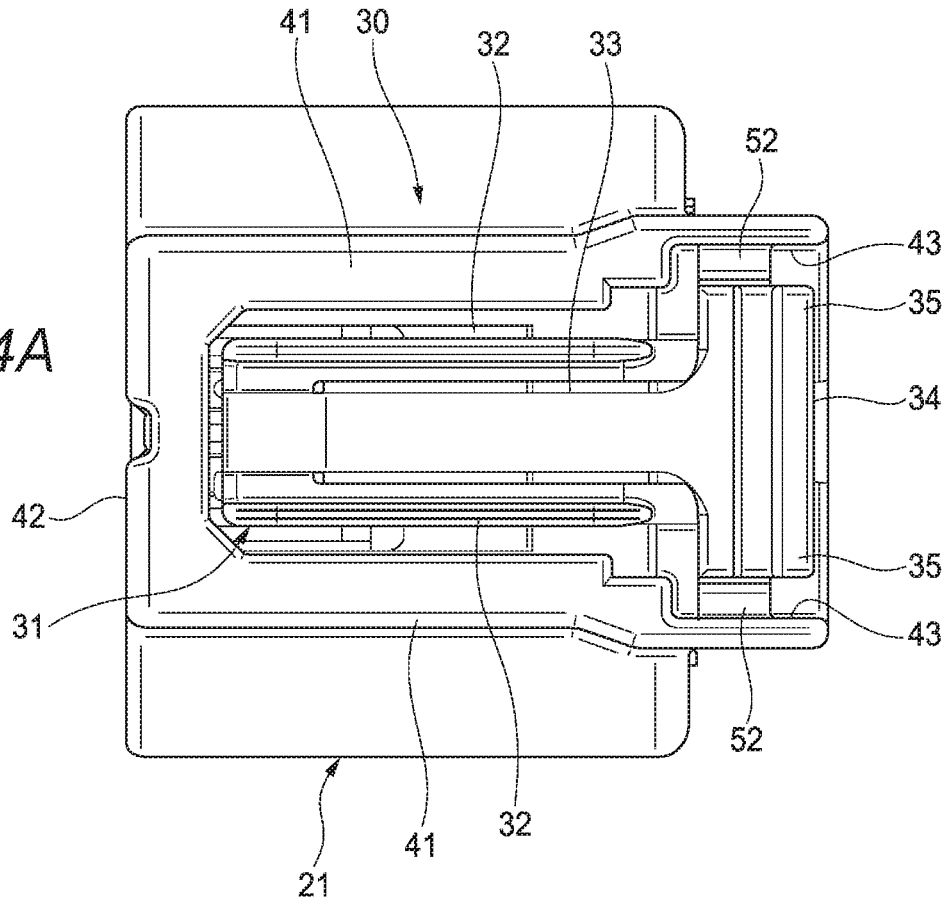
Figure 4B:
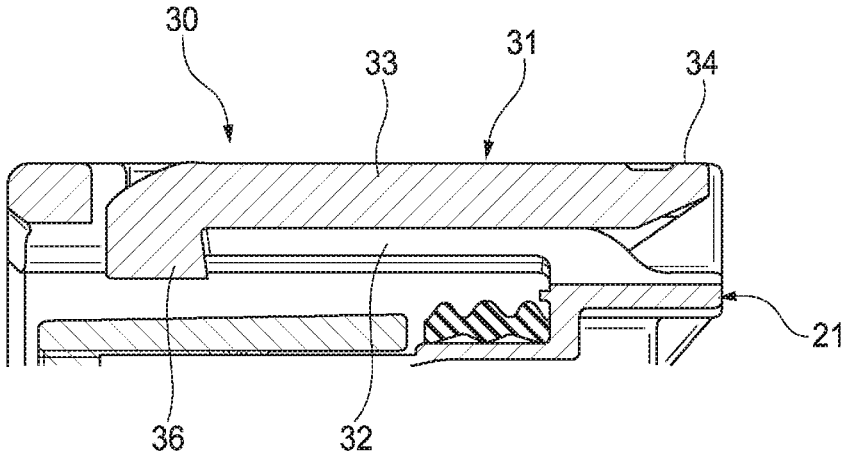

FIGS. 4A and 4B are views showing a lock mechanism of the female housing, in which FIG. 4A is a top view of the female housing, and FIG. 4B is a longitudinal cross-sectional view of an upper portion of the female housing.

As illustrated in FIGS. 4A and 4B, a lock mechanism 30 is provided on an upper portion of the housing body 21 in the female housing 20. The lock mechanism 30 includes a lock arm 31. The lock arm 31 includes a pair of support arms 32 and a swingable arm 33. The support arms 32 are connected to the housing body 21. The support arms 32 are formed in a cantilever manner having a beam shape extending toward the front in the fitting direction. The support arms 32 are arranged in parallel to and spaced apart from each other. The swingable arm 33 is provided between the pair of support arms 32. The swingable arm 33 extends toward the opposite of the fitting direction, with an end portion thereof on the front side in the fitting direction being connected to each of the support arms 32. The swingable arm 33 includes an operation portion 34 at a rear end portion of the swingable arm 33, the rear end portion being opposite to a side where the swingable arm 33 is connected to the support arm 32, i.e., the swingable arm 33 includes the operation portion 34 at the rear end portion in the fitting direction. The operation portion 34 has an extension portion 35 extending to lateral sides, i.e., in the widthwise direction. A lock claw 36 protruding toward a housing body 21, i.e., protruding inward, is formed at a front end of the lock arm 31. The support arm 32 and swingable arm 33 are connected at the front end of the lock arm 31. In the lock arm 31, the swingable arm 33 is swung by the support arm 32 being elastically deformed.

The lock mechanism 30 includes a pair of protective walls 41. Each of the protective walls 41 respectively faces each of lateral sides of the lock arm 31 along the lengthwise direction. The protective walls 41 laterally surrounds the lock arm 31 and thereby protecting the lateral sides of the lock arm 31. A beam 42 is provided on the front side of the protective walls 41 in the fitting direction. Both lateral ends of the beam 42 are connected to the protective walls 41. The beam 42 is spaced apart from the housing body 21. The protective walls 41 each have a recessed portion 43 in a rear end portion of the fitting direction. The recessed portion 43 is provided as a recess disposed in a laterally inner side of each of the protective walls 41. The extension portion 35 formed in the operation portion 34 of the swingable arm 33 is surrounded by the recessed portion 43 of the protective wall 41.

Figure 5A:
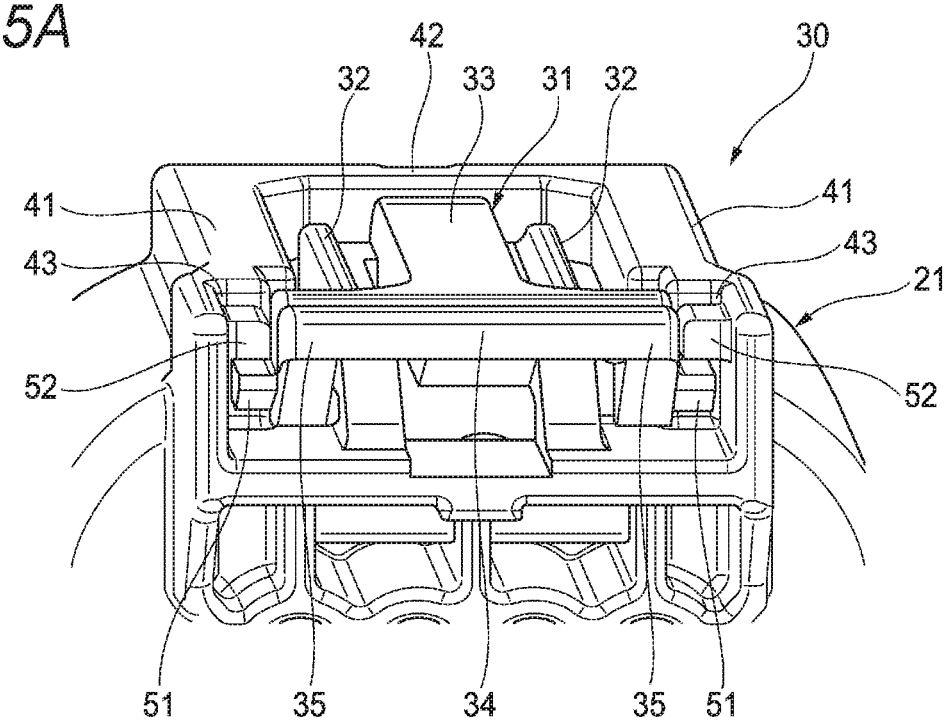
Figure 5B:
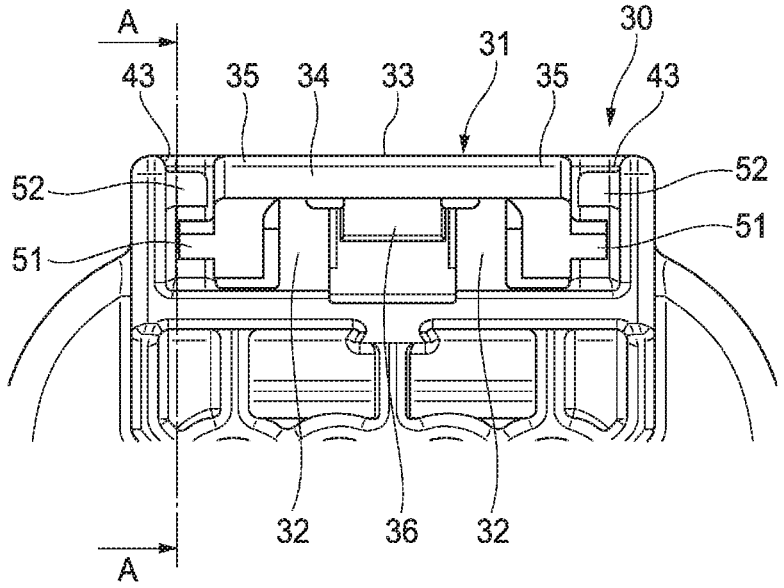

FIGS. 5A and 5B are views showing the lock mechanism of the female housing, in which FIG. 5A is a perspective view of the upper portion of the female housing as view from a rear side, and FIG. 5B is a rear view of the upper portion of the female housing. FIG. 6 is a view showing a turn-up preventing projection and a locking projection, in which FIG. 6A is a perspective view of a cross section taken along a line A-A in FIG. 5B, and FIG. 6B is a cross-sectional view taken along the line A-A in FIG. 5B.

As illustrated in FIGS. 5A and 5B, the lock mechanism 30 includes a locking projection 51 provided on the swingable arm 33 of the lock arm 31, and a turn-up preventing projection 52 provided on the protective wall 41.

Figure 6A:
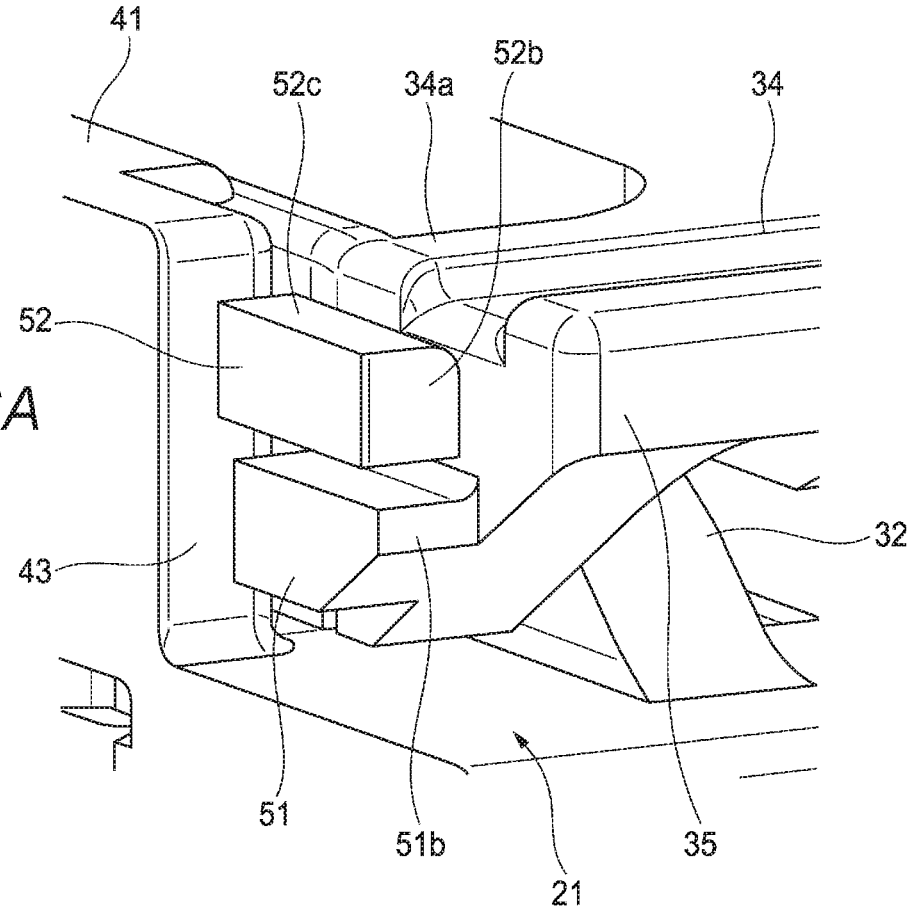
Figure 6B:
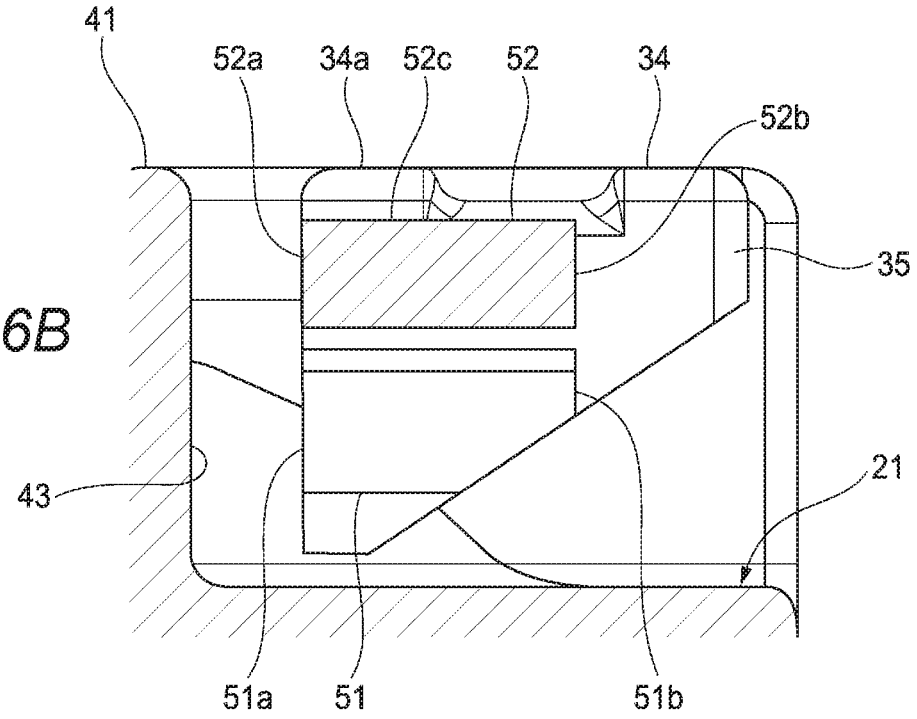

As illustrated in FIGS. 6A and 6B, the locking projection 51 is formed on an end surface of the extension portion 35 in the widthwise direction, the extension portion 35 being provided in the operation portion 34 of the swingable arm 33, and protrudes from the extension portion 35 toward the protective wall 41. The turn-up preventing projection 52 is formed on a bottom surface of the recessed portion 43, i.e., a surface of the recessed portion 43 facing the extension portion 35, of the protective wall 41, and protrudes from the recessed portion 43 toward the operation portion 34 of the swingable arm 33.

The turn-up preventing projection 52 is provided such that a lower surface of the turn-up preventing projection 52 faces an upper surface of the locking projection 51, i.e., turn-up preventing projection 52 is provided above the locking projection 51. The locking projection 51 and the turn-up preventing projection 52 overlap with each other in a swinging direction of the swingable arm 33, i.e., in an upper-lower or vertical direction perpendicular to the fitting direction, at a rear end of the swingable arm 33. The locking projection 51 and the turn-up preventing projection 52 are spaced apart from each other in the upper-lower direction.

A front end surface 51*a* of the locking projection 51 and a front end surface 52*a* of the turn-up preventing projection 52, which are respective end surfaces on the front side in the fitting direction of the locking projection 51 and the turn-up preventing projection 52, are flush with each other along the upper-lower direction. Rear end surfaces 51*b* and 52*b*, which are respective end surfaces on a rear side of the locking projection 51 and the turn-up preventing projection 52 in the fitting direction, are flush with each other along the upper-lower direction. The turn-up preventing projection 52 is provided closer to the housing body 21 than the lock arm 31, and an upper surface 52*c* thereof is disposed closer to the housing body 21 than an upper surface 34*a* of the operation portion 34 of the swingable arm 33 of the lock arm 31.

Next, how the female housing 20 of the connector 10 is to be fitted to the male housing 70 will be described.

The fitting portion 22 is fitted to the male housing 70 by bringing the hood portion 20*a* of the female housing 20 toward the connection portion 70*a* of the male housing 70. Then, the lock mechanism 30 is guided by the guide projection 71 of the male housing 70, and the lock claw 36 of the lock arm 31 of the female housing 20 comes into contact with the guide surface 73 of the projection portion 72 of the male housing 70.

When the female housing 20 is pushed toward to the male housing 70, the lock claw 36 of the lock arm 31 being in contact with the guide surface 73 of the projection portion 72, gets on and starts sliding on the guide surface 73, and the support arm 32 of the lock arm 31 is elastically deformed. Accordingly, the swingable arm 33 of the lock arm 31 swings with a front end side of the swingable arm 33 having the lock claw 36 is moved in a direction away from the housing body 21.

By further pushing the female housing 20 with respect to the male housing 70, the lock claw 36 proceeds and reaches a position further in the fitting direction than the projection portion 72. When the lock claw 36 is in the position, an inner surface of the lock claw 36, the inner surface extending in the upper-lower direction, faces a surface of the projection portion 72, the surface being opposite to the guide surface 73 and extending in the upper-lower direction. What has happened is, the support arm 32 that has been elastically deformed gets restored, thereby swinging back the swingable arm 33, and the lock claw 36 slides over the projection portion 72 toward the front side in the fitting direction and is locked with the projection portion 72. Accordingly, the female housing 20 is fitted to the male housing 70 being locked thereto.

In this fitted state, the connection portion 70*a* of the male housing 70 contacts the seal member 28 attached to the fitting portion 22 of the female housing 20 in a tight manner, and the portion at which the male housing 70 and the female housing 20 are joined is reliably sealed. Further, in this fitted state, the male terminal is inserted into the electrical connection portion 27 of the female terminal 25, and the female terminal 25 and the male terminal are electrically connected.

Next, how the female housing 20 is to be detached from the male housing 70 will be described.

To detach the female housing 20 from the male housing 70, the operation portion 34 at the rear end of the swingable arm 33 in the lock arm 31 of the female housing 20 is pushed toward the housing body 21.

Then, the swingable arm 33 is swung, and the front end side of the lock arm 31 is moved in the direction away from the housing body 21. Accordingly, the lock claw 36 gets away from the housing body 21, the lock claw 36 is released from a locking with the projection portion 72, and the female housing 20 is released from a locked state with the male housing 70.

In this state, the female housing 20 is moved in a direction in which the female housing 20 gets away from the male housing 70. Accordingly, the female housing 20 is detached from the male housing 70, and electrical connection between the female terminal 25 and the male terminal is cut.

As in the present embodiment, in the connector 10 including the lock arm 31 in which the swingable arm 33 swings, when the rear end of the swingable arm 33 is excessively lifted by an external force, the swingable arm 33 may be excessively swung and be broken or damaged.

However, in the connector 10 according to the present embodiment, the locking projection 51 is provided on the swingable arm 33, and further the turn-up preventing projection 52 is provided on the protective wall 41. Therefore, the swingable arm 33 of the lock arm 31 is prevented from being excessively swung by the locking projection 51 being brought into contact with the turn-up preventing projection 52 of the protective wall 41. In other words, breakage or damage that may be caused by excessive lifting of the rear end of the swingable arm 33 due to an external force can be prevented. Further, even when the swingable arm 33 is pulled away from the housing body 21 by being pulled together with a mold being removed at the time of removing the mold after molding of the female housing 20, the locking projection 51 comes into contact with the turn-up preventing projection 52 of the protective wall 41. Therefore, it is possible to prevent turn-up of the swingable arm 33.

In a structure including the locking projection 51 and the turn-up preventing projection 52 formed at respective positions overlapping with each other in the upper-lower direction, if the turn-up preventing projection 52 being positioned at an outer side, i.e., at an upper side in the upper-lower direction than the locking projection 51 is larger in size than the locking projection 51, the mold cannot be removed along the upper-lower direction in which the locking projection 51 and the turn-up preventing projection 52 overlap with each other due to an undercut. In such a case, in order to form the female housing 20, a complicated mold that is finely divided is required, resulting in an increase in the manufacturing cost. On the contrary, when the turn-up preventing projection 52 on an outer side than the locking projection 51 is reduced in size with respect to the housing body 21, an effect of preventing turn-up of the swingable arm 33 by the turn-up preventing projection 52 is reduced.

However, according to the connector 10 of the present embodiment, the front end surfaces 51*a* and 52*a*, and the rear end surfaces 51*b* and 52*b* of the locking projection 51 and the turn-up preventing projection 52 are flush with each other in the direction perpendicular to the fitting direction, i.e., the upper-lower direction. Therefore, after injection molding of the female housing 20 using a mold, the mold can be removed along the front end surfaces 51*a* and 52*a* and the rear end surfaces 51*b* and 52*b*. Accordingly, the mold for forming the female housing 20 can be simplified, and the manufacturing cost can be reduced.

Further, the locking projection 51 and the turn-up preventing locking projection 52, which come into contact with each other when the swingable arm 33 swings, come into contact with each other over entire lengths thereof in the fitting direction, i.e. a longitudinal direction of the connector 10, since the front end surfaces 51*a* and 52*a* thereof, and the rear end surfaces 51*b* and 52*b* thereof are flush with each other. That is, a force generated when the swingable arm 33 swings can be received by the entire length of the turn-up preventing projection 52 in the fitting direction, and the effect of preventing turn-up of the swingable arm 33 can be sufficiently exhibited.

In addition, since the turn-up preventing projection 52 is formed in the recessed portion 43 on a lock arm 31 side in the protective wall 41, the turn-up of the swingable arm 33 can be prevented and an increase in size of the connector 10 due to the turn-up preventing projection 52 can be prevented.

In addition, since the turn-up preventing projection 52 is provided closer to the housing body 21 than the lock arm 31, the turn-up of the swingable arm 33 can be prevented while preventing an increase in size of the connector 10 due to the turn-up preventing projection 52.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

According to an aspect of the embodiments described above, a connector (10) includes a housing (female housing 20) having a housing body (21) configured to be fitted to a mating housing (male housing 70), a lock arm (31) provided on an outer periphery of the housing body (21), the lock arm (31) being configured to engage with a projection portion (72) of the mating housing (male housing 70) to lock the projection portion (72), and a protective wall (41) provided upright on the housing body (21) and extending along both sides of the lock arm (31). The lock arm (31) includes a swingable arm (33) extending along a fitting direction in which the housing (female housing 20) is fitted to the mating housing (male housing 70), the swingable arm (33) being supported such that the swingable arm (33) is swingable relative to the housing body (21), a lock claw (36) provided on a front side of the swingable arm (33) in the fitting direction, the lock claw (36) projecting toward the housing body (21), the lock claw (36) being configured to lock the projection portion (72) when the housing body (21) is fitted to the mating housing (male housing 70) and a locking projection (51) provided at a rear side of the swingable arm (33) in the fitting direction, the locking projection (51) laterally projecting from both sides of the swingable arm (33). The protective wall (41) includes a turn-up preventing projection (52) projecting toward the swingable arm (33), the turn-up preventing projection (52) being provided such that the locking projection (51) is disposed between the housing body (21) and the turn-up preventing projection (52) and such that the locking projection (51) and the turn-up preventing projection (52) overlap each other in a direction in which the swingable arm (33) swings. With respect to the fitting direction, a front end surface (51*a*) of the locking projection (51) and a front end surface (52*a*) of the turn-up preventing projection (52) are flush with each other and a rear end surface (51*b*) of the locking projection (51) and a rear end surface (52*b*) of the turn-up preventing projection (52) are flush with each other.

According to the connector having the configuration described above, by virtue of the locking projection formed on the swingable arm of the lock arm coming into contact with the turn-up preventing projection formed on the protective wall, the swingable arm is prevented from swinging excessively. Therefore, breakage or damage due to an external force of the lock arm can be prevented. Moreover, since the front end surfaces and the rear end surfaces of the locking projection and the turn-up preventing projection are flush with each other, a mold can be removed along the front end surfaces and the rear end surfaces after the housing is molded by injection molding using a mold. Accordingly, the mold for forming the housing can be simplified, and the manufacturing cost can be reduced. Further, the locking projection and the turn-up preventing locking projection, which come into contact with each other when the swingable arm swings, come into contact with each other over entire lengths thereof in the fitting direction in which the female housing is fitted to the male housing, since the front end surfaces thereof, and the rear end surfaces thereof are flush with each other. That is, a force generated when the swingable arm swings can be received by the entire length of the turn-up preventing projection in the fitting direction, and an effect of preventing turn-up of the swingable arm can be sufficiently exhibited.

The protective wall (41) may further include a recessed portion (43) facing the lock arm (31). The turn-up preventing projection (52) may be provided in the recessed portion (43).

With this configuration, since the turn-up preventing projection is formed on the recessed portion facing the lock arm side in the protective wall, the swingable arm can be prevented from turning up and an increase in size of the connector due to the turn-up preventing projection can be suppressed.

An upper surface of the turn-up preventing projection (52) may be provided closer to the housing body (21) than an upper surface of the lock arm (31).

With this configuration, since the turn-up preventing projection is provided closer to the housing body than the lock arm, the swingable arm can be prevented from turning up while suppressing an increase in size of the connector due to the turn-up preventing projection.

What is claimed is:

1. A connector comprising a housing, the housing comprising a housing body configured to be fitted to a mating housing:

a lock arm provided on an outer periphery of the housing body, the lock arm being configured to engage with a projection portion of the mating housing to lock the projection portion; and a protective wall provided upright on the housing body and extending along both sides of the lock arm, wherein the lock arm comprises:

a swingable arm extending along a fitting direction in which the housing is fitted to the mating housing, the swingable arm being supported such that the swingable arm is swingable relative to the housing body;

a lock claw provided on a front side of the swingable arm in the fitting direction, the lock claw projecting toward the housing body, the lock claw being configured to lock the projection portion when the housing body is fitted to the mating housing; and a locking projection provided at a rear side of the swingable arm in the fitting direction, the locking projection laterally projecting from both sides of the swingable arm, wherein the protective wall comprises a turn-up preventing projection projecting toward the swingable arm, the turn-up preventing projection being provided such that the locking projection is disposed between the housing body and the turn-up preventing projection and such that the locking projection and the turn-up preventing projection overlap each other in a direction in which the swingable arm swings, and wherein, with respect to the fitting direction, a front end surface of the locking projection and a front end surface of the turn-up preventing projection are flush with each other and a rear end surface of the locking projection and a rear end surface of the turn-up preventing projection are flush with each other.

2. The connector according to claim 1, wherein the protective wall further comprises a recessed portion facing the lock arm, and wherein the turn-up preventing projection is provided in the recessed portion.

3. The connector according to claim 1, wherein an upper surface of the turn-up preventing projection is provided closer to the housing body than an upper surface of the lock arm.

* * * * *